US006062196A

United States Patent [19]

Haboldt

[11] Patent Number: 6,062,196

[45] Date of Patent: May 16, 2000

[54] METHOD AND ARRANGEMENT FOR CONTROLLING AN ACTUATOR ASSEMBLY OF A DRIVE UNIT

[75] Inventor: Ralf Haboldt, Nordheim, Germany

[73] Assignee: Robert Bosch GmbH, Stuttgart, Germany

[21] Appl. No.: 09/182,476

[22] Filed: Oct. 30, 1998

[30] Foreign Application Priority Data

Oct. 31, 1997 [DE] Germany ..... 197 48 128

[51] Int. Cl.[7] ..... F02M 3/08

[52] U.S. Cl. ..... 123/339.16; 123/339.25

[58] Field of Search ..... 123/339.14, 339.25, 123/339.26, 339.18, 339.16

[56] References Cited

U.S. PATENT DOCUMENTS

| | | | |
|---|---|---|---|
| 3,768,450 | 10/1973 | Harrison | 123/339.28 |
| 4,441,471 | 4/1984 | Kratt et al. . | |
| 4,475,503 | 10/1984 | Nakamura et al. | 123/339.19 |
| 4,479,472 | 10/1984 | Shimamura | 123/339.18 |
| 4,555,762 | 11/1985 | Ohgami et al. | 123/339.19 |
| 4,580,535 | 4/1986 | Danno et al. | 123/339.22 |
| 4,790,276 | 12/1988 | Sasaki | 123/339.22 |
| 5,645,032 | 7/1997 | Motose | 123/339.16 |

FOREIGN PATENT DOCUMENTS

| | | | |
|---|---|---|---|
| 2 091 004 | 7/1982 | United Kingdom | 123/339.25 |

*Primary Examiner*—Erick R. Solis
*Attorney, Agent, or Firm*—Walter Ottesen

[57] ABSTRACT

The invention relates to a method and an arrangement for controlling an actuator unit of a drive unit. In a first operating state, the actuator unit is controlled in dependence upon a desired rpm and an actual rpm. This first operating state is present when the actuator unit is in its idle position or the road speed drops below a pregiven threshold value.

16 Claims, 4 Drawing Sheets

METHOD AND ARRANGEMENT FOR CONTROLLING AN ACTUATOR ASSEMBLY OF A DRIVE UNIT

BACKGROUND OF THE INVENTION

A method and an arrangement for controlling an actuator unit of a drive unit is disclosed, for example, in U.S. Pat. No. 4,441,471. The actuator unit described in this patent defines a bypass position element for controlling the idle speed and is adjusted in the context of an idle rpm control when the throttle flap is closed. Outside of this operating state, the actuator unit is driven with at least one pregiven drive signal whereby it assumes a specific position. When the accelerator pedal is actuated and the throttle flap is opened, a movement out of the idle state takes place and the actuator unit is driven into a pregiven position. In the region of smaller throttle flap openings (for example, when parking), an unfavorable course of the rpm can occur when switching in higher loads such as power steering or climate control because of the nonactive idle control and the fixed position of the actuator unit and the small opening of the throttle flap. In extreme cases, this can lead to stalling of the engine. Stalling of the engine is especially the case in systems wherein a throttle flap actuator is used for idle control. In such systems, the idle rpm control is undertaken directly via the throttle flap in that a drive of a displaceable stop of the throttle flap is correspondingly actuated. This drive is lead to a specific position when there is a movement out of the idle range, that is, when the throttle flap is lifted from the stop. If this position is less than the idle position, then this can lead to a stalling of the drive unit when switching in higher loads during parking.

SUMMARY OF THE INVENTION

It is an object of the invention to improve the performance of the drive unit when the throttle flap is only slightly open.

The method of the invention is for controlling an actuator for actuating a throttle element of a drive unit of a motor vehicle. The drive unit includes an idle rpm control and the method includes the steps of: adjusting the actuator in a first operating state of the drive unit in the context of the idle rpm control with the first operating state being present when the throttle element is in the idle position thereof; and, determining the first operating state to be also present when the throttle element lies outside of the idle position and the moving speed of the motor vehicle is below a pregiven threshold value.

The performance of the drive unit when the throttle flap is only slightly open (for example, when parking), is significantly improved. It is especially advantageous that an unfavorable course of the rpm is avoided by the driving-speed dependent activation of the idle control when switching in a load (such as a consumer) for a throttle flap which is only slightly open. Stalling of the drive unit is therefore effectively avoided in this operating state or is at least made much more difficult.

It is further advantageous that the parking operation can even be supported when the driver actuates the accelerator pedal and thereby opens the idle switch. If the rpm is reduced when parking by switching in a power-intensive consumer, the rpm behavior is improved by switching in the idle rpm control.

It is especially advantageous that the actuator unit is controlled to a predetermined position only when the driving speed is above a pregiven threshold different than zero. This predetermined position is a position which is less than compared to the idle state. Stalling of the engine because of switching in consumers is avoided.

BRIEF DESCRIPTION OF THE DRAWINGS

The invention will now be explained with reference to the drawings wherein.

DESCRIPTION OF THE PREFERRED EMBODIMENTS OF THE INVENTION

Figure 1:
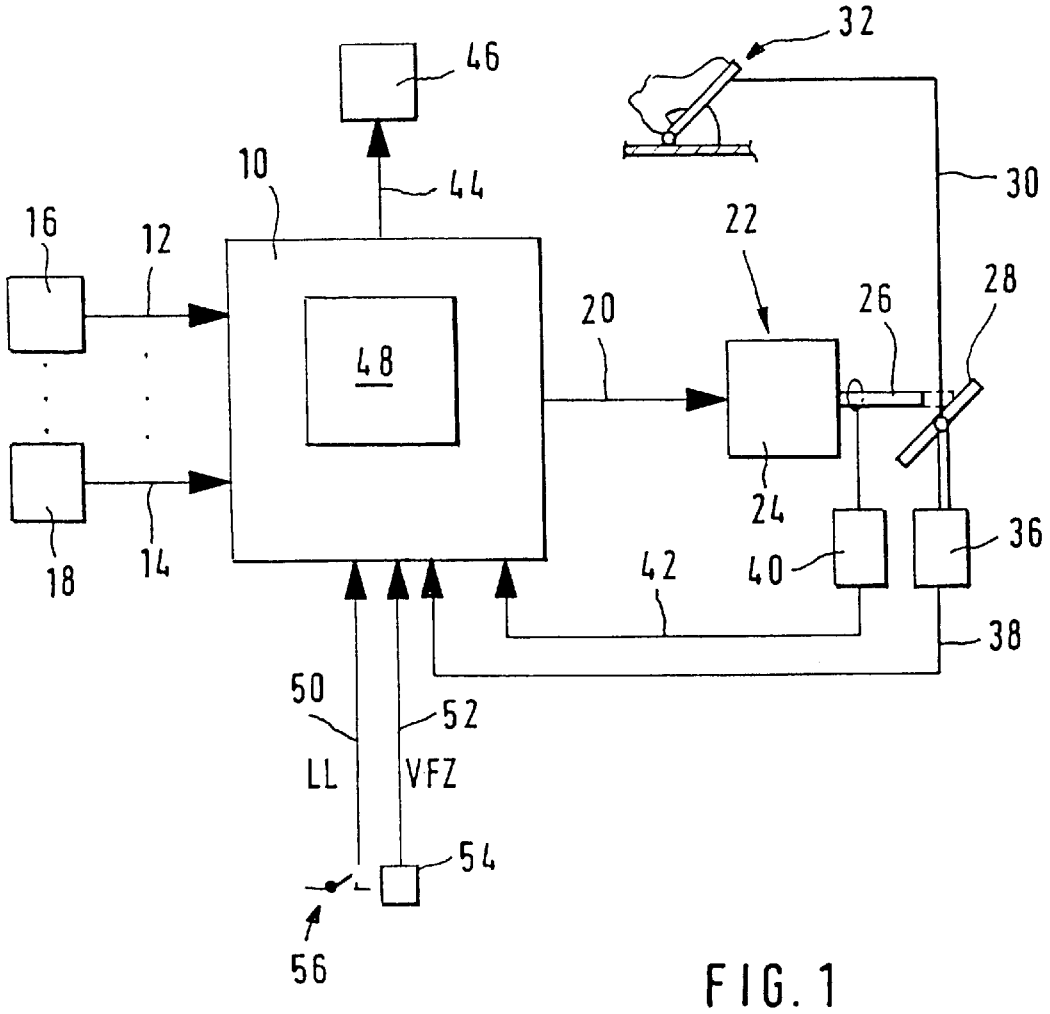
FIG. 1 is an overview block circuit diagram of a control arrangement for an actuator unit of a drive unit.

FIG. 1 shows a preferred embodiment of the invention with an actuator unit which includes an actuator operatively connected to the throttle flap when the accelerator pedal is released. Reference numeral 10 identifies a control unit which includes at least one microcomputer 48. Input lines 12 to 14 from measuring devices 16 to 18, respectively, lead to the control unit 10. An output line 20 extends from the control unit 10 to an actuator 22, which, in a preferred embodiment, comprises a motor 24 and a movable stop 26. Furthermore, a throttle flap 28 is provided which is mounted in an air induction system (not shown) of an internal combustion engine (also not shown). The throttle flap 28 is connected via a mechanical connection 30 to an operator-controlled element 32 actuable by the driver. The operator-controlled element 22 is preferably an accelerator pedal.

In addition, the throttle flap 28 is connected to a first position transducer 36 having an output line 38 leading to the control unit 10. The position of the actuator 22 is detected by a second position transducer 40 having an output line 42 likewise leading to the control unit 10. Additional output lines 44 are provided which lead to positioning elements 46 for influencing other operating variables of the internal combustion engine such as the fuel metering and/or ignition time point setting.

Signals are supplied to the control unit via lines 50 and 52 with the signal on line 52 coming from measuring device 54. Reference numeral 56 identifies the idle switch. These signals represent the vehicle speed VFZ and data LL with respect to the contact engagement of the throttle flap 28 on the movable stop 26. The contact engagement of the throttle flap on the stop 26 is detected by a switch element connected to the throttle flap, the accelerator pedal or the stop.

By actuating the accelerator pedal 32, the driver controls the throttle flap 28 via the mechanical connection 30 and thereby adjusts the power of the drive unit. The position of the throttle flap 28 and therefore the position of the accelerator pedal 32 is detected by the first position transducer 36 which, in the preferred embodiment, is a potentiometer. A corresponding measurement value UDKPOT is outputted via line 38 to the control unit 10. The control unit 10 is supplied with operating variables of the engine and/or of the vehicle via the lines 12 to 14. These operating variables include, for example, engine temperature, engine rpm, battery voltage, air throughput, status of the ancillary consumers, et cetera. In the idle case, when the driver has released the accelerator pedal 32, the throttle flap 28 lies against the movable stop 26 of the actuator 22, that is, the actuator 22 and the throttle flap 28 are operatively connected to each other.

An rpm desired value is determined in the control unit 10 for controlling the idle position of the throttle flap 28, especially for controlling the idle rpm of the engine. This rpm desired value is determined, for example, on the basis of an rpm controller in dependence upon operating variables such as engine temperature, the status of ancillary consumers, the engine rpm, et cetera. This rpm desired value is placed into relationship with the rpm actual value and a drive signal for the actuator 22 is formed by a control unit in dependence upon the deviation in accordance with a pregiven control strategy (for example, PID). This drive signal is outputted via the output line 20.

According to another embodiment of the invention, and in addition to the rpm control loop, the actuator unit is adjusted in the context of subordinated control loops which include positioning, load and torque or air mass control loops. The output signal of the rpm control loop is used as a desired value for the downstream controller (such as a position controller), set into relationship with the corresponding actual value (for example, the position data of the measuring device 36 or 40) and the control signal for the actuator unit is formed in correspondence to the implemented control strategy. This drive signal for the actuator unit is formed in dependence upon the deviation between desired and actual values.

Figure 2:
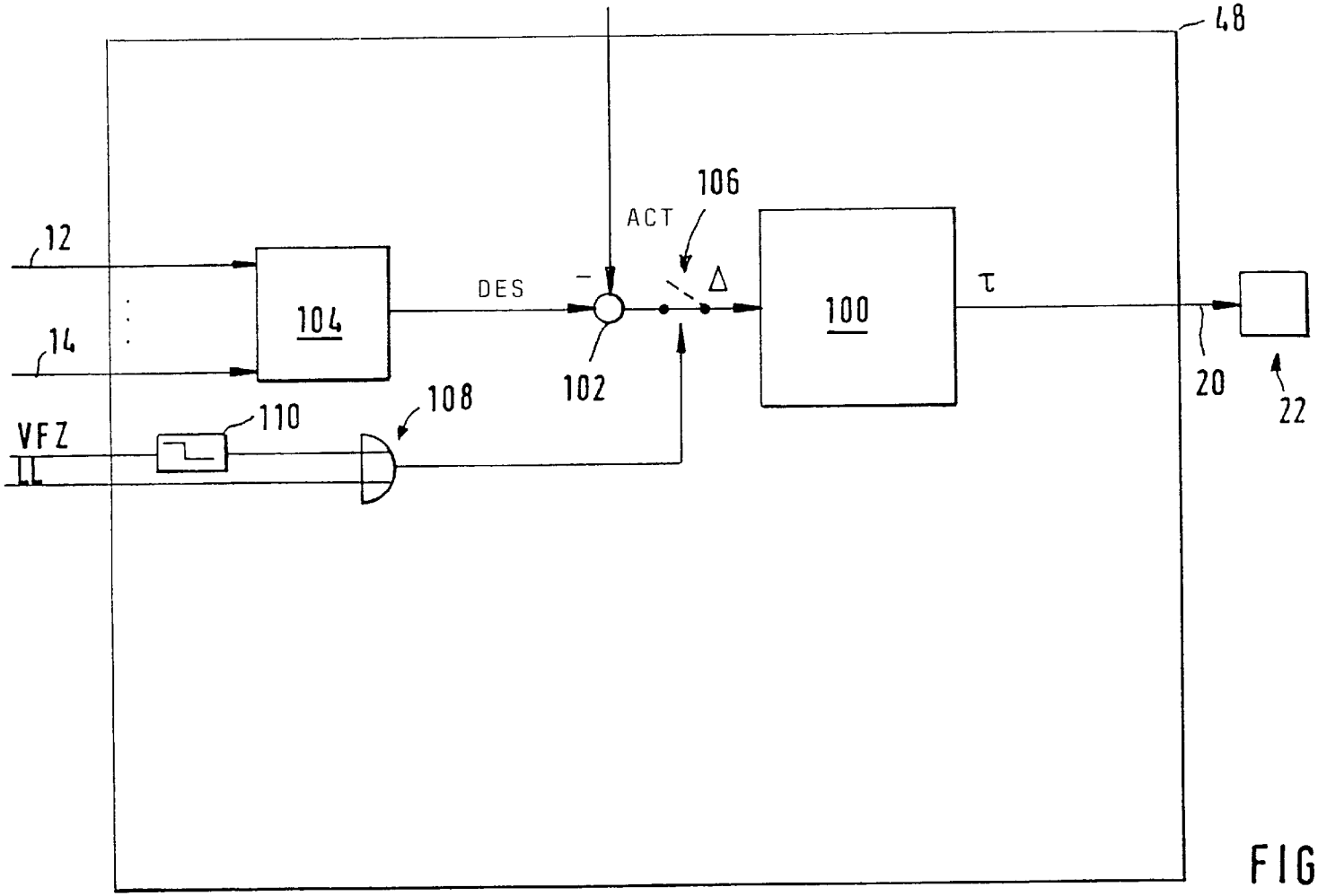
FIG. 2 is a sequence diagram of a first preferred embodiment of the invention presenting a program which runs in a microcomputer.

In FIG. 2, a first preferred embodiment is shown in the context of a sequence diagram. The diagram defines a program which runs in the microcomputer 48.

In FIG. 1, a controller 100 is shown which generates an output signal $\tau$ in dependence upon an input quantity $\Delta$. The output signal $\tau$ serves to control the actuator unit 22 via the output line 20. Depending upon the embodiment, this controller can be one of the following: a position controller which controls the position of the actuator unit; an rpm controller which guides the actual rpm to the desired rpm; or, the controller can be an air controller, a torque controller or a load controller which receives the corresponding deviation as an input quantity and adjusts the actuator unit in the sense of bringing the actual value to the desired value.

The deviation $\Delta$ is formed in a logic element 102 from the supplied desired value and the measured actual value ACT. The desired value DES is determined in the desired-value former 104 in dependence upon operating variables of the engine and/or vehicle. These operating variables are supplied via the lines 12 to 14. Operating variables of this kind include, for example, engine temperature, the status of ancillary consumers et cetera. To deactivate the controller 100, a switching element 106 is shown which closes for activation and opens for deactivation so that, in the last case, the control deviation 0 is supplied to the controller. This switch element is actuated from a logic OR-element in dependence upon vehicle speed VFZ and the idle data LL and, if required, other conditions such as the intervention of an engine drag torque control, et cetera. The supplied vehicle speed signal VFZ is compared to a pregiven threshold value (in block 110). If the vehicle speed signal drops below this threshold value, which is greater than 0 and can be at several km/h (for example, 5 to 20 km/h), then a corresponding signal is supplied via the OR logic-element 108 to the switch element 106. The signal also closes or holds the switch closed when idle data is not present, that is, when the idle switch is not closed. Correspondingly, the control is activated independently of the vehicle speed when the idle switch is closed and the idle data is present. Other data (for example, the data of an active drag torque control) are likewise utilized in the OR-element 108. If a drag torque control is active, then the control is likewise active.

In addition to the realization of the deactivation of the controller 100 by means of a switchoff or switchover of the control deviation to the value 0, the integral component of the control 100 is stopped or reset in other embodiments. In one embodiment, the proportional component and/or the differential component can be stopped. Here, it can also be provided that only the integral component is stopped; whereas, the proportional component continues to run at least under specific conditions. Furthermore, the deactivation of the rpm control is realized in that the rpm controller output signal no longer becomes effective for the adjustment of the actuator unit (see, for example, the embodiment of FIG. 3).

Figure 3:
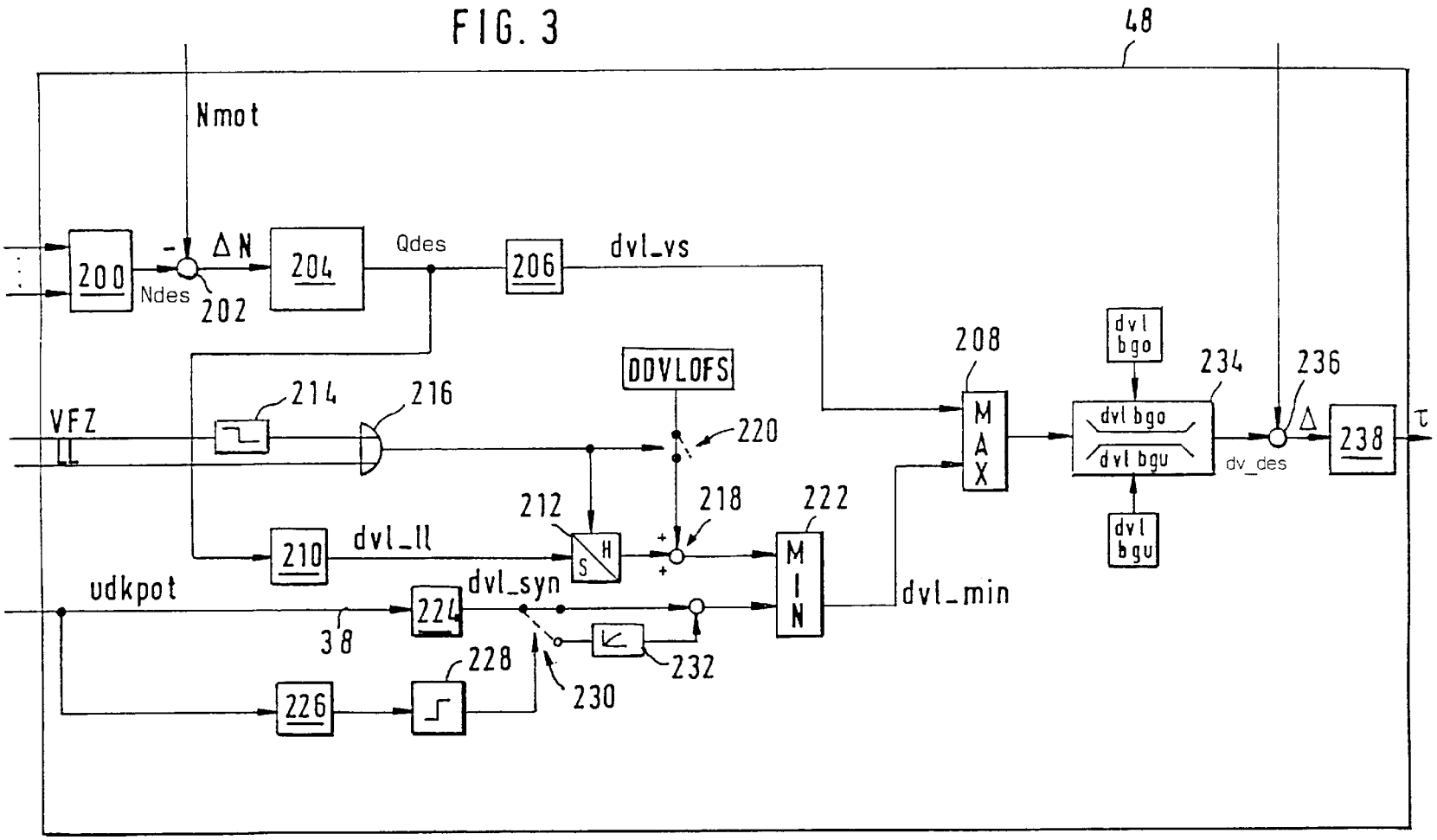
FIG. 3 is a sequence diagram showing a second embodiment of the invention which represents a program running in the microcomputer; and, FIGS. 4*a* to 4*d* are respective time diagrams for explaining the operation of the control provided by the invention.

In FIG. 3, a further embodiment is shown in the context of a sequence diagram. In this embodiment, an actuator unit is utilized which, as shown in FIG. 1, has a movable stop for adjusting the idle position of the throttle flap. The sequence diagram shown in FIG. 3 represents a program running in the microcomputer 48.

A desired idle rpm Ndes is determined in an rpm desired value former 200 in dependence upon operating variables of the engine and/or of the vehicle. These operating variables include the engine temperature, the status of ancillary consumers, et cetera. The desired idle rpm Ndes is compared to the measured actual value of the rpm Nmot in the logic element 202 and the deviation $\Delta N$ is supplied to the rpm controller 204. The controller 204 determines an output signal Qdes in accordance with a pregiven control strategy such as a PID-control. The output signal Qdes corresponds to the desired air (for example, air mass, charge, et cetera) which is needed for causing the actual rpm to approximate the desired rpm. Block 206 defines, for example, a characteristic line. In block 206, the desired air value is corrected with other functions as may be needed (for example, a dash-pot function) and is converted into a desired positioning value dvl_vs for the throttle flap that is, for the actuator unit. The desired positioning value is supplied to a maximum value selector 208. Furthermore, in block 210, the desired air value is converted into a positioning value dvl_ll which corresponds to the idle air requirement. This takes place in a preferred embodiment likewise by means of a characteristic line or in another embodiment in the context of an adaptation.

The idle air requirement value is supplied to a sample-hold function 212. If a logic 0 is present at the other input of this sample-hold function, then the output of the sample-hold function is held at the last value. For a logic 1, the output signal corresponds to the input signal. A logic 0 is present when none of the conditions are present which were described with respect to FIG. 2, that is, when the rpm controller is deactivated. This is the case when no idle signal is present and the vehicle speed is above the threshold value (threshold value 214, OR-element 216). In this case, the last input value is retained.

If the vehicle speed drops below the threshold value or if an idle signal is present, a logic 1-signal is supplied via the OR-element 216 to the sample-hold function so that the output signal is equal to the input signal dvl_ll in this operating state.

The output signal of the sample-hold function is conducted to a logic element 218. There, an offset value DDVLOFS is switched in for a closed switch element 220. The switch element 220 is closed when a logic 0-signal is present from the OR-element 216, that is, when the input signal from block 212 is frozen. The sum of the two signals is supplied to a minimum value selector 222. The idle air requirement value dvl_ll is applied to the minimum value selector 222 in the active range of the rpm control; whereas, outside of this operating state, the stored requirement value plus an offset value DDVLOFS is applied.

The position UDKPOT of the throttle flap is detected via the line 38 and, in a characteristic line 224, is converted into a position value dvl_syn for the actuator as a precontrol value. Furthermore, the throttle flap position is differentiated as a function of time in block 226 and is compared to a threshold value 228. A switch element 230 is switched over in dependence upon whether the threshold value is exceeded or there is a drop therebelow. For slow throttle flap ranges (switch element 230 shown by the solid line), this leads to the situation that the precontrol value dvl_syn is filtered by a time constant 232 (lowpass) and supplied to the minimum value selector 222. For rapid changes (switch element 230 in the position shown by the broken line), the value dvl_syn is supplied directly to the minimum value selector 222.

The output signal of the minimum value selector is transmitted to the maximum value selector 208. The output signal of the maximum value selector 208 is supplied to a limiter 234 in that the output signal is limited to a maximum value DVLBGO and a minimum value DVLBGU. The output signal defines the desired value signal dv_des for the position of the actuator unit which is compared to the actual value in the logic element 236 to form the control deviation Δ. The control deviation Δ is converted by the position controller 238 in accordance with a pregiven control strategy into a drive signal quantity τ for the actuator unit. This drive signal quantity τ leads to the actual position approximating the pregiven desired position and therefore to the actual rpm approaching the desired rpm.

The rpm controller 204 outputs the desired air value Qdes in dependence upon the difference between the desired and actual rpm values. This desired value is converted by block 206 into an unlimited desired value dvl_vs for the position of the actuator unit which corresponds to the position of the throttle flap when the operative connection is present. This conversion takes place while considering further functions, which act on the throttle flap position, such as a dashpot function. The unlimited desired value is supplied via the maximum value selection to the position controller.

In the maximum value selector 208, the unlimited desired value is compared to a minimum value dvl_min. The larger of the two values is transmitted to the control as a desired value. In this way, the desired value dvl_vs cannot drop below the minimum possible value. This has significance when a large precontrol (derived from the throttle flap position UDKPOT) and a small desired value (as a consequence of the actual rpm present via the desired rpm) are present when the idle switch is opened. Without the minimum limiting, the position controller would actuate the stop in the sense of a throttle flap opening and, in this way, possibly catch up to the throttle flap so that the idle switch is again closed. The idle switch closes for an operative connection between the throttle flap and the stop. Because of the minimum limiting, the desired value cannot be less than the minimum value dvl_min so that the described situation cannot occur.

The minimum value is formed in the minimum value selector 222 on the basis of precontrol and idle required value. The precontrol only becomes effective when the throttle flap has opened correspondingly wide. As long as the idle required value dvl_ll is less than the precontrol value increased by a specific amount, the idle required value defines the minimum value. If the conditions for the idle operation (OR-element 216) are no longer present, then the idle required value is frozen or held and an offset value is algebraically added to the frozen value.

If the precontrol value is less than the idle required value (which is the case outside of the idle operating state), the precontrol operates via the minimum value as desired value for the position controller. Since the precontrol is increased by an amount, the actuator in this case is reduced (when, as in the preferred embodiment, the actuator assumes a smaller position with increasing position measurement signal).

The idle switch is prevented from again closing by holding the idle air requirement when the idle air requirement changes, for example, via the rpm. By reducing the drive, the drivability in the region near idle is improved. However, this applies only for a rolling vehicle. To permit the idle control to support, for example parking, an intervention of the idle controller is made ready by the definition of the idle range on the basis of the road speed even when the idle switch is open and there is ineffective precontrol.

The threshold value for the road speed is then so fixed that the threshold value of the speed in first gear corresponds to an rpm of approximately 1200 rpm. If the rpm should be greater in the context of a function for heating the catalytic converter, then this is considered in a preferred embodiment in that a higher speed threshold value is pregiven.

In FIG. 4, the operation of the procedure described with respect to the embodiment of FIG. 3 is explained in the context of time diagrams. FIG. 4*a* shows the time-dependent trace of the idle switch LL and FIG. 4*b* shows the road speed VFZ as a function of time. FIG. 4*c* shows the engine rpm Ninot and FIG. 4*d* shows the trace of the position (dvl_pos) of the actuator unit.

Up to time point $T_0$, there is normal idle with a released accelerator pedal (idle switch=LL) and the vehicle at standstill. At time point $T_0$, the driver actuates the accelerator pedal which leads to opening of the idle switch (see FIG. 4*a*). The vehicle then assumes some speed for parking. The speed remains below the speed threshold VFZDVL (see FIG. 4*b*). The rpm control is active in this operating range.

Figure 4A:
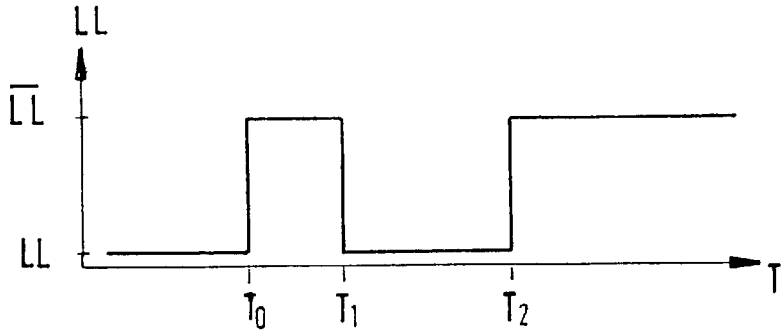
Figure 4B:
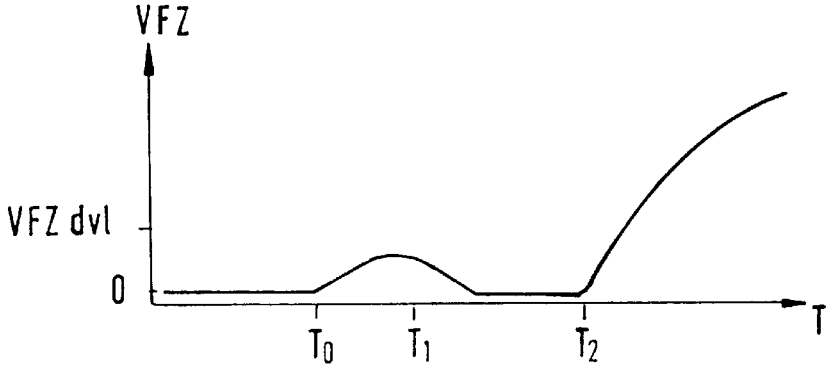
Figure 4C:
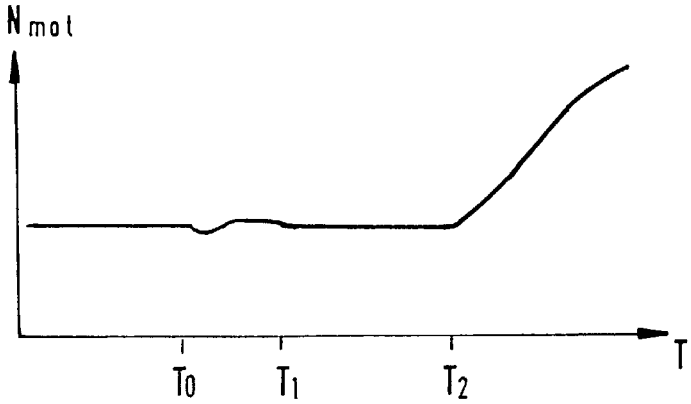
Figure 4D:
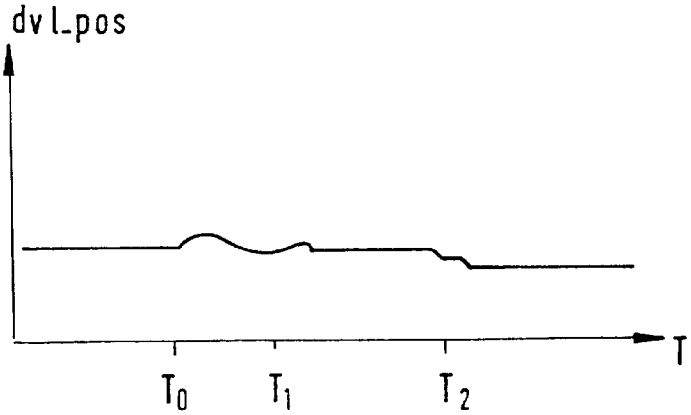

The actuator position therefore results from the rpm trace which first drops slightly after the time point $T_0$ in the example of FIG. 4*c* and then increases to again correspond to the desired value at time point $T_1$. The reverse behavior shows the trace of the actuator position in accordance with FIG. 4*d*. At time point $T_2$, the driver actuates the accelerator pedal in order to drive away. Shortly after time point $T_2$, the road speed exceeds the threshold value (see FIG. 4*b*). This leads to the situation that the idle control is deactivated shortly after time point $T_2$ and the actuator unit is driven to a precontrol value (see FIG. 4*d*).

It is understood that the foregoing description is that of the preferred embodiments of the invention and that various changes and modifications may be made thereto without departing from the spirit and scope of the invention as defined in the appended claims.

What is claimed is:

1. A method for controlling an actuator for actuating an element of a drive unit of a motor vehicle for adjusting said drive unit, the drive unit including an idle rpm control for generating an output signal for adjusting said actuator, the method comprising the steps of:

adjusting said actuator in a first operating state of said drive unit with said first operating state being present when said element is in the idle position thereof and wherein said idle rpm control is active; and, detecting the moving speed of said motor vehicle while said idle rpm control is deactivated and said element has moved to a position away from said idle position;

comparing the moving speed of said motor vehicle to a pregiven threshold value and generating a vehicle speed signal; and, when said moving speed is less than said pregiven threshold value, again activating said idle rpm control only on the basis of said vehicle speed signal.

2. The method of claim 1, comprising the further steps of:

providing an idle switch which assumes a first switching state when said element is in said idle position and assumes a second switching state when said element is away from said idle position; and, causing said idle rpm control to also operate on said actuator when said idle switch assumes said second switching state and said moving speed of said motor vehicle lies below said pregiven threshold value.

3. The method of claim 2, comprising the further step of at least partially deactivating said idle rpm control when said drive unit operates outside of said first operating state and said moving speed of said motor vehicle is greater than said pregiven threshold value.

4. The method of claim 3, comprising the further step of controlling said actuator to at least a pregiven value outside of said first operating state.

5. The method of claim 4, comprising the further step of adjusting said actuator in the context of a position control.

6. The method of claim 5, comprising the further steps of:

causing said rpm control to determine a desired value of said position control in said first operating state; and, deriving said desired value from a precontrol value outside of said first operating state.

7. The method of claim 6, comprising the further step of providing a precontrol outside of said first operating state with said precontrol being dependent on the position of said element and said element being a throttle flap actuable by the driver of said motor vehicle.

8. The method of claim 7, wherein said precontrol is not effective during said first operating state.

9. The method of claim 6, comprising the further steps of:

determining a desired position value from said idle rpm control;

comparing said precontrol value to a position value in the context of a minimum value selection with said position value being dependent upon the output of said idle rpm control;

taking the smaller of said precontrol value and said position value as a minimum value in the context of a maximum value selection and comparing said minimum value to said desired position value; and, forming the desired value for said position control of said actuator.

10. The method of claim 1, comprising the further steps of:

configuring said element as a throttle flap;

configuring said actuator to have a motor with a movable stop to displace said throttle flap; and, causing said stop to be no longer operatively connected to said throttle flap when the driver actuates the accelerator pedal of said motor vehicle.

11. The method of claim 6, comprising the further step of causing said precontrol to adjust a smaller position of said actuator outside of said operating state than was present when said drive unit moved out of said first operating state.

12. The method of claim 1, wherein said element is a throttle flap of said drive unit.

13. An arrangement for controlling an actuator for actuating an element of a drive unit of a motor vehicle for adjusting said drive unit, the arrangement comprising:

a control apparatus including at least one microcomputer for controlling said actuator in a first operating state of said drive unit in dependence upon desired and actual rpm values;

said control apparatus further including means for detecting said first operating state when said element is in the idle position thereof; and, said detecting means being adapted to detect said first operating state also when said element is outside of said idle position and the moving speed of said motor vehicle is less than a pregiven threshold value.

14. The method of claim 13, wherein said element is a throttle flap of said drive unit.

15. An arrangement for controlling an actuator for actuating an element of a drive unit of a motor vehicle for adjusting said drive unit, the arrangement comprising:

means for forming a desired value of the rpm of said drive unit;

means for detecting the actual value of the rpm of said drive unit;

a control apparatus including at least one microcomputer for controlling said actuator in a first operating state of said drive unit in dependence upon said desired and actual values of rpm;

said control apparatus further including an idle control for controlling said drive unit in idle during said first operating state when said element is in the idle position thereof;

said idle control including an idle switch which can be switched into a closed position to activate said idle control and into an open position to deactivate said idle control;

means for detecting the moving speed of said motor vehicle while said drive unit is not in idle and said element has moved away from said idle position thereof;

means for comparing the moving speed of said motor vehicle to a pregiven threshold value; and, means for again activating said idle control when said moving speed is less than said pregiven threshold value and when said idle switch is in said open position.

16. The arrangement of claim 15, wherein said element is a throttle element.

* * * * *

UNITED STATES PATENT AND TRADEMARK OFFICE

CERTIFICATE OF CORRECTION

PATENT NO. : 6,062,196
DATED : May 16, 2000
INVENTOR(S) : Ralf Haboldt

It is certified that error appears in the above-identified patent and that said Letters Patent is hereby corrected as shown below:

Column 6,
Line 30, delete "Ninot" and substitute -- Nmot -- therefor.

Column 8,
Line 23, delete "method" and substitute -- arrangement -- therefor.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*